US007419585B2

(12) United States Patent
Maa et al.

(10) Patent No.: US 7,419,585 B2
(45) Date of Patent: Sep. 2, 2008

(54) PROCESS FOR UPGRADING RESIDUA

(75) Inventors: Peter S. Maa, Baton Rouge, LA (US); Craig Y. Sabottke, Baton Rouge, LA (US)

(73) Assignee: Exxonmobil Research and Engineering Company, Annandale, NJ (US)

( * ) Notice: Subject to any disclaimer, the term of this patent is extended or adjusted under 35 U.S.C. 154(b) by 317 days.

(21) Appl. No.: 10/337,243

(22) Filed: Jan. 6, 2003

(65) Prior Publication Data

US 2003/0159973 A1 Aug. 28, 2003

Related U.S. Application Data

(63) Continuation-in-part of application No. 09/838,742, filed on Apr. 19, 2001, now abandoned.

(60) Provisional application No. 60/200,854, filed on May 1, 2000.

(51) Int. Cl.
*C10G 9/32* (2006.01)

(52) U.S. Cl. ..... 208/126; 208/113; 208/127; 208/129; 208/151; 208/153; 208/157; 208/164; 208/209; 208/213; 208/390; 208/400; 208/424; 208/427; 208/434

(58) Field of Classification Search ..... 208/113, 208/127, 157, 390, 400, 424, 434, 427, 151, 208/153, 164, 129, 213, 126, 209
See application file for complete search history.

(56) References Cited

U.S. PATENT DOCUMENTS 3,870,621 A * 3/1975 Arnold et al. ..... 208/415
4,985,136 A * 1/1991 Bartholic ..... 208/153
5,041,209 A * 8/1991 Cha et al. ..... 208/251 R
5,188,805 A * 2/1993 Sabottke ..... 422/111
5,298,155 A 3/1994 Sabottke ..... 208/157
5,514,252 A 5/1996 Kerby, Jr. et al. ..... 205/696
5,584,986 A * 12/1996 Bartholic ..... 208/151
5,658,455 A 8/1997 Hammond et al. ..... 208/127
5,714,056 A 2/1998 Hammond et al. ..... 208/127
6,179,997 B1 1/2001 Vedder, Jr. et al. ..... 208/113

FOREIGN PATENT DOCUMENTS

WO WO97/04041 2/1997
WO WO98/59018 12/1998

(Continued)

OTHER PUBLICATIONS

Fujita, et al., *Olefins from Heavy Oils*, Chemical Engineering Progress, pp. 76-84 (Jan. 1983).

(Continued)

*Primary Examiner*—Glenn Caldarola
*Assistant Examiner*—Prem C. Singh
(74) *Attorney, Agent, or Firm*—Erik S. Wilson; Bruce M. Bordelon

(57) ABSTRACT

A process for upgrading a residua feedstock using a short vapor contact time thermal process unit comprised of a horizontal moving bed of fluidized hot particles. The residua feedstock is preferably atomized so that the Sauter mean diameter of the residua feedstock entering the reactor is less than about 2500 μm. One or more horizontally disposed screws is preferably used to fluidize a bed of hot particles.

7 Claims, 1 Drawing Sheet

FOREIGN PATENT DOCUMENTS

| | | |
|---|---|---|
| WO | WO00/63320 | 10/2000 |

OTHER PUBLICATIONS

Weiss, et al., *Coke of Residue Oils by the LR-Process*, Petrochemie/Hydrocarbon Technology, vol. 42, pp. 235-237 (1989).

Weiss, et al., *Coking of Oil, Sand, Asphaltenes and Residual Oils in the LR-Process*, Fourth UNITAR/UNDP International Conference on Heavy Crude and Tar Sands, Edmonton, Canada (Aug. 1988).

Weiss, *LR-Technology for Direct Coking of Tar Sand*, Paper presented at the AIChe 1983 Summer National Meeting, Denver, Colorado, pp. 1-12 (Aug. 1983).

Getty Oil Company Diatomite Project, 1983 Summer National Meeting, AIChE Presentation, Denver, Colorado, pp. 1-4 (Aug. 1983).

* cited by examiner

PROCESS FOR UPGRADING RESIDUA

CROSS-REFERENCE TO RELATED APPLICATION

This application is a continuation-in-part of U.S. patent application Ser. No. 09/838,742 filed Apr. 19, 2001, now abandoned which claims benefit of U.S. provisional patent application Ser. No. 60/200,854 filed May 1, 2000.

BACKGROUND

The present invention relates to upgrading a residua feedstock using a short vapor contact time thermal process unit comprised of a horizontal moving bed of fluidized hot particles.

In a typical refinery, crude oils are subjected to atmospheric distillation to separate lighter materials such as gas oils, kerosenes, gasolines, straight run naphtha, etc. from the heavier materials. The residue from the atmospheric distillation step is then distilled at a pressure below atmospheric pressure. This later distillation step produces a vacuum gas oil distillate and a vacuum reduced residual oil that often contains relatively high levels of asphaltene molecules. These asphaltene molecules usually contain most of the Conradson Carbon residue and metal components of the resid. They also contain relatively high levels of heteroatoms, such as sulfur and nitrogen. Such feeds have low commercial value, primarily because they cannot be directly used as a fuel oil because of environmental regulations. They also have little value as feedstocks for refinery processes, such as fluid catalytic cracking, because they produce excessive amounts of gas and coke and their high metals content causes catalyst deactivation. Thus, a need exists in petroleum refining for a process for upgrading residual feeds to more valuable cleaner and lighter feeds.

There are a number of techniques used for recovering the lighter components from various petroleum residual feeds that contain high concentrations of alphaltenes. Many such processes involve separation, via extraction, of the lighter components with a deasphalting solvent such as propane, and thereafter separating and recovering the lighter components from the solvent. Other processes may use solvents that include lower alkanes, alkenes, and their halogenated derivatives, and even carbon dioxide and ammonia under certain circumstances. These processes use conventional physical separation techniques, with little or no significant chemical reactions occurring.

There is nevertheless a continuing need in the art for an upgrading and conversion process that yields higher amounts of liquid products. There is also a need in the art for a conversion process that can upgrade an asphalt-containing residual feedstock without using a solvent, while increasing liquid product yields and without causing an increase in dry gas and coke yields.

SUMMARY

In the present invention the asphaltene molecules in the residua feed are the highest boiling materials and are strongly adsorbed on the hot circulating solids. Applicants have discovered that conventional feed patterns and spray droplets sizes result in agglomeration and bogging of the feed within small areas of the reactor, thus decreasing yields. By controlling the feed droplet size and ensuring uniform spray distribution to the hot solids, the total liquid product yield can be increased and the dry gas and coke yield decreases. By atomizing the incoming residua feed, the competitive adsorption of the molecules in the feed can be influenced so that some of the asphaltenes thermally crack in chemical reactions (unlike the prior solvent-based processes) to lighter liquid products while other asphaltenes go to coke deposited on the circulating solids.

Accordingly, one embodiment of the present invention comprises a process for upgrading a residua feedstock to produce an increase in total liquid products in a process unit comprising (i) a heating zone wherein solids containing carbonaceous deposits are received from a stripping zone and heated in the presence of an oxidizing gas; (ii) a short vapor contact time reaction zone containing a horizontal moving bed of fluidized hot solids recycled from the heating zone, which reaction zone is operated at a temperature from about 450° C. to about 700° C. and operated under conditions such that substantially all of the solids that are passed from the heating zone pass through the reaction zone and wherein the solids residence time is from about 5 to about 60 seconds, and the vapor residence time is less than about 4 seconds in the reactor; and (iii) a stripping zone through which solids having carbonaceous deposits thereon are passed from the reaction zone and wherein lower boiling hydrocarbons and volatiles are recovered with a stripping gas.

The process itself comprises the steps of: (a) atomizing the residua feedstock so that the residua feedstock has a liquid droplet size less than about 2500 μm Sauter mean diameter; (b) passing the atomized liquid residua feedstock to the short vapor contact time reaction zone where it contacts the fluidized hot solids, thereby resulting in high Conradson Carbon components and metal-containing components being deposited onto said hot solids, and a vaporized fraction; (c) separating the vaporized fraction from the solids; and (d) passing the solids to said stripping zone where they are contacted with a stripping gas, thereby removing volatile components therefrom; (e) passing the stripped solids to a heating zone where they are heated to an effective temperature that will maintain the operating temperature of the reaction zone; and, (f) recycling hot solids from the heating zone to the reaction zone such that substantially all of the solids that are passed from the heating zone pass through the reaction zone and where they are contacted with fresh feedstock.

BRIEF DESCRIPTION OF THE FIGURE

The FIG. 1 illustrates an embodiment of the present invention.

DETAILED DESCRIPTION

Figure 1:
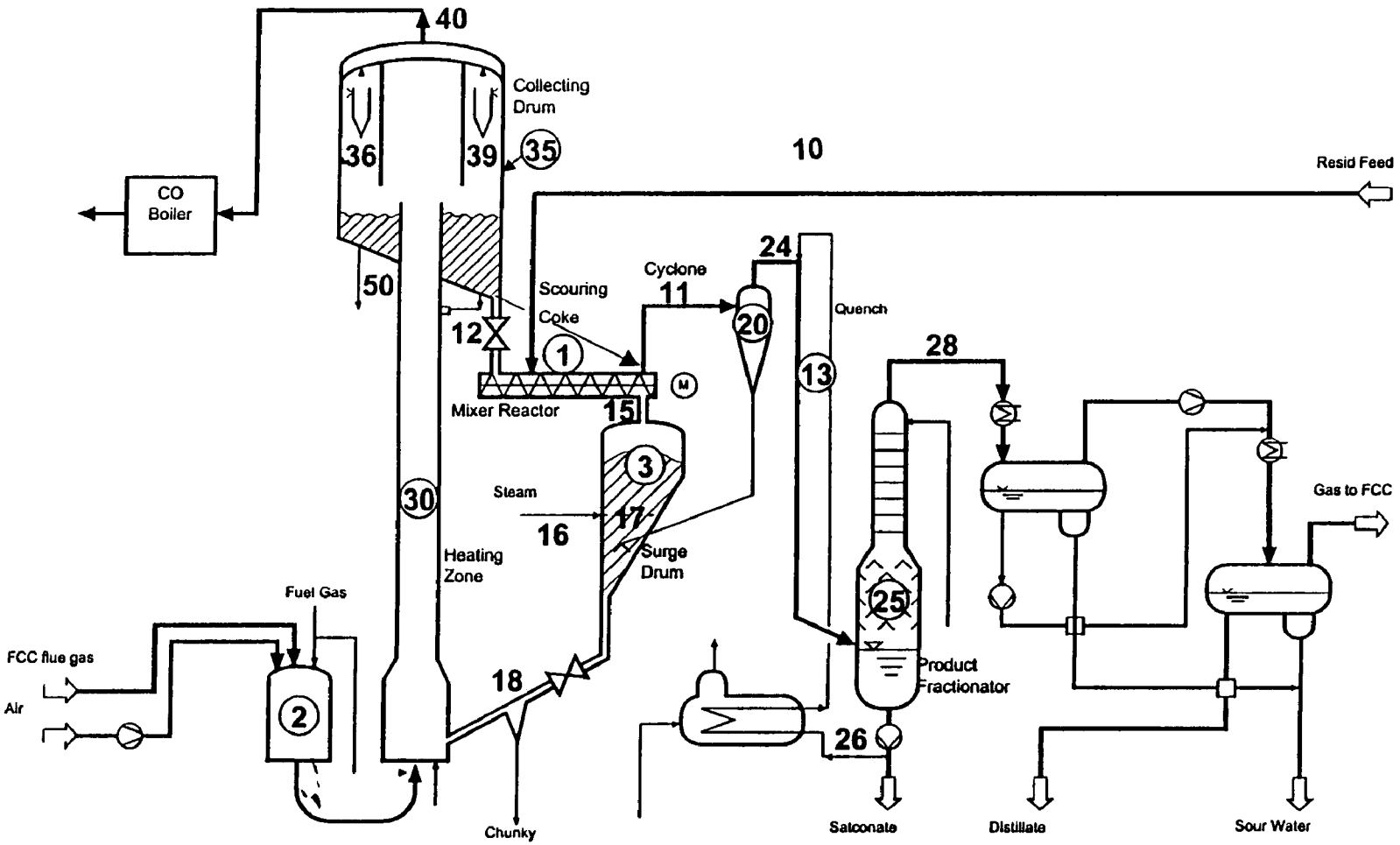

Residua feedstocks that may be upgraded by using the present invention are those petroleum fractions boiling above about 480° C., preferably above about 510° C., more preferably above about 540° C., and even more preferably above about 560° C. Non-limiting examples of such fractions include vacuum resids, atmospheric resids, heavy and reduced petroleum crude oil, pitch, asphalt, bitumen, tar sand oil, shale oil, coal, coal slurries, and coal liquefaction bottoms. These resids may also contain minor amounts of lower boiling material. Residua feedstocks cannot be fed in substantial quantities to refinery process units, such as FCC units, because they are typically high in Conradson Carbon and contain an undesirable amount of metal-containing components. Conradson Carbon residues will deposit on the FCC cracking catalyst and causes excessive deactivation. Metals, such as nickel and vanadium, also deactivate the catalyst by acting as catalyst poisons. Such feeds will typically have a Conradson carbon content of at least 5 wt. %, generally from about 5 to 55 wt. %. As to Conradson carbon residue, see ASTM Test D189-165.

Residua feedstocks are upgraded in accordance with the present invention in a short vapor contact time process unit comprising a heating zone, a short vapor contact time horizontal fluidized bed reaction zone, and a stripping zone. The short contact time horizontal fluidized bed reaction zone preferably includes one or more feed nozzles that are configured to control the feed droplet size and distribution.

Preferably, the residua feed is atomized before passing via line 10 into reaction zones 1 to achieve a fine spray pattern into reaction zones 1. Preferably the mean Sauter diameter of the liquid residua feed droplets is less than 2500 μm, more preferably less than 700 μm, more preferably between about 300 μm and about 1400 μm, and more preferably between about 600 μm and about 800 μm. Coarser feed spray patterns, i.e., having a Sauter mean diameter greater than about 2500 μm, typically result in lower total liquid product (TLP) yields and higher dry gas and coke yields. Maldistribution of the incoming feed results in localized bogging and agglomeration of the feed. A fine spray from the feed nozzle(s) ensures better penetration, mixing and contact between the liquid feed droplets and the hot solids in the reaction zones 1, and the penetration of the spray depends on the individual reactor geometry. This provides quicker heat transfer to the feed without excessive and localized cooling of the hot solids that may cause bogging and agglomeration of the feed. If too much feed is injected into too small an area within the reaction zones 1, bogging and agglomeration can result. Therefore, the feed is preferably uniformly distributed on the hot solids in the reaction zones 1 through the feed nozzles. If there are a plurality of feed nozzles, the feed is preferably distributed so that equal amounts of feed pass through each feed nozzle. The liquid feed droplet size range should nominally be in a similar size range to the particle diameter size range of the hot circulating solids to optimize the reactor hydrodynamic flow issues and reactor kinetic reaction rate issues. This ensures that a good liquid spray penetration and mixing between the liquid droplets and the hot circulating solid particles occurs.

Although applicants do not wish to be limited by theory, but applicants believe that a decrease in feed droplet size increases the liquid droplet surface area of the feed entering reaction zones 1, improves the heat and mass transfer rate to the feed, and improves the reaction kinetics to achieve the increase in TLP yield and decrease in yields of dry gas and coke.

The residua feed may be atomized in either a conventional manner such that the desired droplet size and distribution is achieved or with a special device that achieves the desired droplet size and droplet size distribution. For example, it may be desirable to vary feed nozzle design and/or size, the amount of steam or inert gas injection, and/or the feed tip temperature. It may be desirable to control both the droplet size and distribution (and preferably reactor residence time) to maximize product yield and quality. Preferably, the spray distribution from the feed nozzles is such that the feed makes good contact and penetration with the bed of hot solids within the reaction zones. Examples of suitable nozzles may be found in U.S. Pat. Nos. 5,188,805 and 5,466,364. Preferably, an inert gas or steam is used to assist in the atomization of the feed through the feed nozzle.

Referring to the FIGURE, a residua feedstock high in Conradson Carbon and/or metal-components passes via line 10 to one or more short-vapor-contact-time reaction zones 1 that contains a horizontal moving bed of fluidized hot solids. A mechanical apparatus, preferably one or more horizontally disposed mixing screws fluidize the solids in the short vapor contact time reactor. A fluidizing gas, such as steam, fluidizes the particles. The mixer and the formation of vapors resulting from the vaporization of at least a fraction of the residua feedstock also assist fluidization. Preferably, the mechanical means is a mechanical mixing system having a relatively high mixing efficiency with only minor amounts of axial backmixing. This mixing system acts like a plug flow system with a flow pattern that ensures that the residence time is nearly equal for all particles. A preferred mechanical mixer is the mixer referred to by Lurgi AG of Germany as the LR-Mixer or LR-Flash Coker which was originally designed for processing for oil shale, coal, and tar sands. The LR-Mixer consists of two horizontally oriented co-rotating screws that aid in fluidizing the particles. Other screw-type mechanical mixers may also be used.

The solid particles are preferably (petroleum) coke particles, but they may also comprise any other suitable refractory particulate material. Non-limiting examples of such other suitable refractory materials include silica, alumina, zirconia, magnesia, or mullite, synthetically prepared or naturally occurring material such as sand, pumice, clay, kieselguhr, diatomaceous earth, bauxite, and the like. It is within the scope of the present invention that the solids can be inert or have catalytic properties. The solids will have an average particle size of about 300 microns to 1,400 microns, preferably from about 600 microns to about 800 microns. The solid size directly relates to the liquid droplet size.

The fluidized hot solids are preferably at a temperature from about 590° C. to about 760° C., more preferably from about 650° C. to 700° C. When the residua feedstock contacts the hot solids, a substantial portion of the high Conradson Carbon and metal-containing components will deposit on the hot solid particles in the form of high molecular weight carbon and metal moieties. The remaining portion vaporizes on contact with the hot solids. The residence time of vapor products in reaction zones 1 will be an effective amount of time so that substantial secondary cracking does not occur. This amount of time will typically be less than about 4 seconds, preferably less than about 3 seconds, and more preferably less than about 2 seconds. The residence time of solids in the reaction zone will be from about 5 to 60 seconds, preferably from about 10 to about 30 seconds. Suitable length to diameter ratios (L/D) for the reactor are preferably greater than or equal to about 5/1, more preferably greater than or equal to about 11/1 with the L/D for the reaction zone greater than or equal to about 6/1, more preferably greater than or equal to about 10/1, and with the L/D for the reactor mixing zone greater than or equal to about 1/1.

The residence times of the solids and the vapor products are independently controlled. Most fluidized bed processes are designed so that the solids residence time and the vapor residence time cannot be independently controlled, especially at relatively short vapor residence times.

Preferably, the short vapor contact time process unit operates so that the ratio of solids to feed ranges from about 30 to 1, preferably from about 5 or about 10 to about 1. The precise ratio of solids to feed will primarily depend on the heat balance requirement of the short vapor contact time reaction zone. Associating the oil to solids ratio with heat balance requirements is within the skill of those having ordinary skill in the art and thus, will not be elaborated herein any further. A minor amount of the feedstock will deposit on the solids in the form of combustible carbonaceous material. Metal components will also deposit on the solids. Consequently, the vaporized portion will be substantially lower in both Conradson Carbon and metals when compared to the original feed. Preferably, the ration of the hot circulating solids particle diameter to the feed liquid droplet size will be in a range from 0.50 to 2.0, to achieve optimum contacting.

The vaporized fraction passes via line 11 to cyclone 20 that removes most of the entrained solids, or dust. The dedusted vapors then pass to quench zone 13 via line 24 where the temperature of the vapors is reduced to minimize substantial thermal cracking. This temperature is preferably below about 450° C., more preferably below about 340° C. Solids, having carbonaceous material deposited thereon, pass from reaction zones 1 via lines 15 to the bed of solids 17 in stripper 3. The solids pass downwardly through the stripper and past a stripping zone at the bottom section where any remaining volatiles, or vaporizable material, are stripped from the solids using a stripping gas, preferably steam, that is introduced into the stripping zone via line 16. Stripped vapor products pass upwardly in stripper vessel 3, through line 11 to cyclone 20 to quench zone 13 via line 24 to fractionator 25 where a light product is removed overhead via line 28. The light product will typically be 371° C. minus product stream. A 371° C. plus stream is also collected from the quench zone via line 26. The stripped solids pass via line 18 to heating zone 30, where combusted gases from heater 2 lift the coke up and combust part of the coke.

The heating zone operates in an oxidizing gas environment, preferably using air, at an effective temperature that will meet the heat requirements of the reaction zone. The heating zone will typically be operated at a temperature of about 40° C. to 200° C., preferably from about 65° C. to 175° C., more preferably from about 65° C. to 120° C. in excess of the operating temperature of reaction zones 1. Preheated air may be introduced into the heater. The heater will typically be operated at a pressure ranging from about 0 to 150 psig, preferably at a pressure ranging from about 15 to about 45 psig. While some carbonaceous residue will be burned from the solids in the heating zone, preferably only partial combustion occurs so that after passing through the heating zone, the solids will have value as a fuel. Excess solids may be removed from the process unit via line 50. Flue gas passes overhead from heater 2 via line 40. The flue gas passes through a cyclone system 36 and 39 in collection drum 35 to remove most solid fines. Dedusted flue gas further cools in a waste heat recovery system (not shown), scrubbed to remove contaminants and particulate, and passed to a CO boiler. The hot inert solids are then recycled via lines 12 to reaction zones 1.

The following examples are presented to illustrate the present invention and not to be taken as limiting the scope of the invention in any way.

EXAMPLES 1-3

A test was conducted to determine the effect of decreasing the average droplet size of the feed at constant pressure of about 5 psig. The test was conducted by feeding a vacuum resid from an Arab light crude to a horizontal screw mixer reactor having a diameter of 1.26 inches and a length of 14.5 inches. The screw mixer has a 1.58 inch mixing zone and a 12.9 inch reaction zone where the feed was contacted with hot solid particles consisting of sand having a Sauter mean diameter of about 200 μm at operating temperatures between 560° C. and 575° C. and a pressure of about 5.2-5.3 psig. The Sauter mean diameter as used herein is calculated by using the empirical equation developed by Nukiyama and Tanasawa [Trans. Soc. Mech. Eng., Japan, 5, 63 (1939)]. The solids circulation rate was controlled using a metering screw upstream of the solids inlet to the screw mixer reactor. The products resulting from the contact between the solids and the feed were collected and passed to a gas/solids separation unit. The resulting gas, or vapor phase, was partially condensed in a hot separator operated at 177° C. to produce a heavier liquid product stream and a vapor product stream. The vapor product stream was partially condensed in a cold separator operated at −2° C. to produce a light product stream and a non-condensable gas stream. The gas stream passed through a wet test meter to measure the volume and collected in a composite gasbag for analysis. The liquid streams from the hot and cold separators were combined to a make up a total liquid product, TLP. Table 1 illustrates the results.

TABLE 1

| Example # | 1 | 2 | 3 |
|---|---|---|---|
| Temperature (° C.) | 568 | 561 | 569 |
| Pressure (psig) | 5.2 | 5.3 | 5.0 |
| Solids Circulation Rate (kg/hr) | 21.6 | 21.2 | 26.2 |
| Feed Rate (kg/hr) | 1.24 | 1.13 | 1.28 |
| Solids/Feed Ratio | 17.4 | 18.8 | 20.5 |
| Hydrocarbon Partial Pressure (bar) | 0.77 | 0.70 | 0.51 |
| Vapor Residence Time (sec) | 2.26 | 2.12 | 2.32 |
| Solids Residence Time (sec) | 30.1 | 30.2 | 29.0 |
| Mean droplet size (μm) (Sauter mean diameter) | 914 | 879 | 232 |
| Hot Solids Particle Diameter/Feed Liquid droplet size ratio | 0.22 | 0.23 | 0.86 |
| Liquid Product (wt %) | 70.8 | 72.0 | 76.4 |
| Coke (wt %) | 19.3 | 20.1 | 16.2 |

EXAMPLES 4-8

Another test was run under process conditions similar to those of Example 1, except that the pressure was raised to about 20 psig and the mean droplet sizes were varied. Table 2 illustrates the results.

TABLE 2

| Examle # | 4 | 5 | 6 | 7 | 8 |
|---|---|---|---|---|---|
| Temperature (° C.) | 569 | 571 | 569 | 569 | 571 |
| Pressure (psig) | 20.3 | 20.1 | 20.2 | 20.1 | 20.0 |
| Solids Circulation Rate (kg/hr) | 23.4 | 39.3 | 27.5 | 38.6 | 40.0 |
| Feed Rate (kg/hr) | 1.58 | 1.63 | 1.67 | 1.58 | 1.33 |
| Solids/Feed Ratio | 14.9 | 24.1 | 16.5 | 24.5 | 30.2 |
| Hydrocarbon Partial Pressure (bar) | 1.52 | 0.93 | 1.86 | 1.06 | 0.92 |
| Vapor Residence Time (sec) | 2.43 | 2.05 | 1.86 | 1.69 | 1.52 |
| Solids Residence Time (sec) | 29.7 | 25.9 | 24.2 | 26.0 | 25.7 |
| Mean droplet size (μm) (Sauter mean diameter) | 2173 | 1608 | 1571 | 971 | 399 |
| Hot Solids Particle Diameter/Feed liquid Droplet size ratio | 0.09 | 0.12 | 0.13 | 0.21 | 0.50 |
| Liquid Product (wt %) | 65.1 | 66.3 | 66.4 | 68.3 | 70.2 |
| Coke (wt %) | 22.5 | 23.2 | 22.4 | 21.7 | 18.1 |

Examples 1-8 in Tables 1-2 illustrate that by decreasing the mean droplet size, an increase in total liquid product is achieved while at the same time decreasing coke yields.

The invention claimed is:

1. A process for upgrading a residua feedstock having a Conradson Carbon content of from about 5 to 55 wt % to produce an increase in total liquid products in a process unit comprising (i) a heating zone wherein solids containing carbonaceous deposits are received from a stripping zone and heated in the presence of an oxidizing gas; (ii) a short vapor contact time reaction zone containing a horizontal moving bed of fluidized hot solids recycled from the heating zone, which reaction zone is operated at a temperature from about 450° C. to about 700° C. and operated under conditions such that substantially all of the solids that are passed from the heating zone pass through the reaction zone and wherein the solids residence time is from about 5 to about 60 seconds, and the vapor residence time is less than about 4 seconds; and wherein said reaction zone is fluidized by a mechanical means comprised of one or more horizontally disposed screws within the reactor; and (iii) a stripping zone through which solids having carbonaceous deposits thereon are passed from the reaction zone and wherein lower boiling hydrocarbons and volatiles are recovered with a stripping gas; said process comprising the steps:

(a) atomizing the residua feedstock so that the residua feedstock has a liquid droplet size between about 300 μm to about 1400 μm Sauter mean diameter;

(b) fluidizing hot solids particle size between about 150 μm to 2800 μm Sauter mean diameter, wherein the ratio of fluidized hot solids particle size to feed liquid droplet size is between 0.5 to 2.0;

(c) passing the atomized liquid residua feedstock to the short vapor contact time reaction zone where it contacts the fluidized hot solids, thereby resulting in high Conradson Carbon components and metal-containing components being deposited onto said hot solids, and a vaporized fraction;

(d) separating the vaporized fraction from the solids;

(e) passing the solids to said stripping zone where they are contacted with a stripping gas, thereby removing volatile components therefrom;

(f) passing the stripped solids to a heating zone where they are heated to an effective temperature that will maintain the operating temperature of the reaction zone; and (g) recycling hot solids from the heating zone to the reaction zone such that substantially all of the solids that are passed from the heating zone pass through the reaction zone and where they are contacted with fresh feedstock.

2. The process according to claim 1 wherein the residua feedstock has a liquid droplet size between about 600 μm and about 800 μm Sauter mean diameter.

3. The process according to claim 1 wherein the vapor residence time of the short vapor contact time reaction zone is less than about 1 second.

4. The process according to claim 1 wherein the residua feedstock is selected from the group consisting of vacuum resids, atmospheric resids, heavy and reduced petroleum crude oil, pitch, asphalt, bitumen, tar sand oil, shale oil, and coal liquefaction bottoms.

5. The process according to claim 4 wherein the residua feedstock is a vacuum resid.

6. The process according to claim 5 wherein the solids residence time of the short vapor contact time reaction zone is from about 10 to 30 seconds.

7. The process according to claim 1 wherein the ratio of the wt % of the liquid fraction obtained from condensing the vapor fraction at −2° C. to the wt % of the coke produced is at least 3.9, wherein the weight percentages are based on the wt % of the residua feedstock.

* * * * *